US011794192B2

(12) United States Patent
Akyurek

(10) Patent No.: US 11,794,192 B2
(45) Date of Patent: Oct. 24, 2023

(54) SESAME SEED HULLING MACHINE

(71) Applicant: AKYUREK KARDESLER TARIM URUNLERI MAKINALARI TASIMACILIK VE MADENCILIK SANAYI TICARET LIMITED SIR-KETI, Icel (TR)

(72) Inventor: Ahmet Akyurek, Mersin Icel (TR)

(73) Assignee: AKYÜREK MAKINE SANAYI VE TICARET ANONIM, Icel (TR)

( * ) Notice: Subject to any disclaimer, the term of this patent is extended or adjusted under 35 U.S.C. 154(b) by 0 days.

(21) Appl. No.: 16/305,388

(22) PCT Filed: Jun. 21, 2017

(86) PCT No.: PCT/TR2017/050282

§ 371 (c)(1),
(2) Date: Nov. 28, 2018

(87) PCT Pub. No.: WO2018/034631

PCT Pub. Date: Feb. 22, 2018

(65) Prior Publication Data

US 2020/0324294 A1 Oct. 15, 2020

(51) Int. Cl.
*B02B 3/00* (2006.01)
*B02B 7/02* (2006.01)

(52) U.S. Cl.
CPC . *B02B 3/00* (2013.01); *B02B 7/02* (2013.01)

(58) Field of Classification Search
CPC ..... B02B 3/00; B02B 7/02
USPC ..... 241/6
See application file for complete search history.

(56) References Cited

U.S. PATENT DOCUMENTS

| | | | | |
|---|---|---|---|---|
| 284,672 A * | 9/1883 | Reynolds | B02B 3/04 99/522 |
| 793,450 A | 6/1905 | Leonard | |
| 1,220,090 A | 3/1917 | Gmeinder | |
| 3,217,769 A * | 11/1965 | Trumanb | B02B 3/04 241/42 |
| 5,025,993 A * | 6/1991 | Satake | B02B 3/00 241/74 |
| 6,610,345 B2 * | 8/2003 | Satake | B02B 1/04 426/483 |

FOREIGN PATENT DOCUMENTS

| | | |
|---|---|---|
| TR | 2003/02097 | 9/2004 |
| TR | 2007/06047 | 10/2007 |

OTHER PUBLICATIONS

International Search Report and the Written Opinion of the International Searching Authority in PCT/TR2017/050282 dated Jan. 26, 2018, 4 pages.

* cited by examiner

*Primary Examiner* — Jimmy T Nguyen
*Assistant Examiner* — Smith Oberto Bapthelus
(74) *Attorney, Agent, or Firm* — Merchant & Gould P.C.

(57) ABSTRACT

The invention is about a hulling machine that is used in facilities producing tahini by using sesame seeds as raw material, and separating the sesame seed from its hull, which enables easier assembly and easier manufacturing at the same time.

9 Claims, 4 Drawing Sheets

SESAME SEED HULLING MACHINE

TECHNICAL AREA

The invention is about a hulling machine that is hulling the sesame seed, to be used in facilities that are using sesame seeds as raw materials to produce tahini.

CURRENT STATE OF THE TECHNIQUE AS KNOWN

In the hulling machines that include the current technique, the fore plates of the body are welded to the chassis by using straight plate which is cut ovally at the top, and extension piece. Because this connection occupies some space, the distance between the cylinders is more than required. Likewise, the bearing chassis is welded. Because this production has too many welded pieces, welding gravity is observed, thus the production is taking longer periods. Interim passage ducts use a lid system, and this is not appropriate in terms of durability and ergonomics. At the product exit, there is a simple slot with a hood. This does not help with separating the exiting product. Additionally, the product gets out of the machine as lumpy.

During the patent research held about the previous technique, a utility model was encountered, with the application number TR 2007/06047. This application is about a sesame seed hulling and cleaning machine, which hulls and cleans the seeds in dry condition.

Another application about the previous technique is a utility model numbered TR2003/02097. This application is about a machine that hulls the raw sesame seeds, separating the seed from the hull. At the first stage, sesame seeds in raw, hulled condition are 50% hulled with the help of the blades in the sesame container. Separated hulls are thrown away at the exit area, with the help of the vacuum of an air turbine. At the second stage, the seeds are completely hulled, with the friction power created by the blades. Thanks to the vacuum created by the air turbine, sesame hulls are vacuumed from the gathering area and thrown away at the exit area. Sesame seeds that are hulled are thrown away through the sesame exit area.

As a result, there are developments on hulling machines which hull sesame seeds in facilities producing tahini using sesame seeds as raw material. Therefore there is a need for new devices which would make up for the above mentioned disadvantages, and provide solutions to current systems.

PURPOSE OF THE INVENTION

The current invention is about a hulling machine that is hulling the sesame seed, to be used in facilities that are using sesame seeds as raw materials to produce tahini.

The primary purpose of the invention is to enable easier assembly, compared to the structures used in the current technique.

One purpose of the invention is, to decrease the machine height, and to create an advantage of shipment.

Another purpose of the invention is, to decrease the production duration. Thus, decreasing the costs together with the decreasing labor and production duration.

One purpose of the invention is, to get rid of the shape deficiencies which are created by welding.

Another purpose of the invention is, building a system including drawers, and obtaining a more durable and handy structure.

Another purpose of the invention is, separating the product from its hull, through a mixing helix with a hood.

FIGURES THAT WILL HELP TO BETTER UNDERSTAND THE INVENTION

DESCRIPTION OF PARTS REFERENCES

Figure 1:
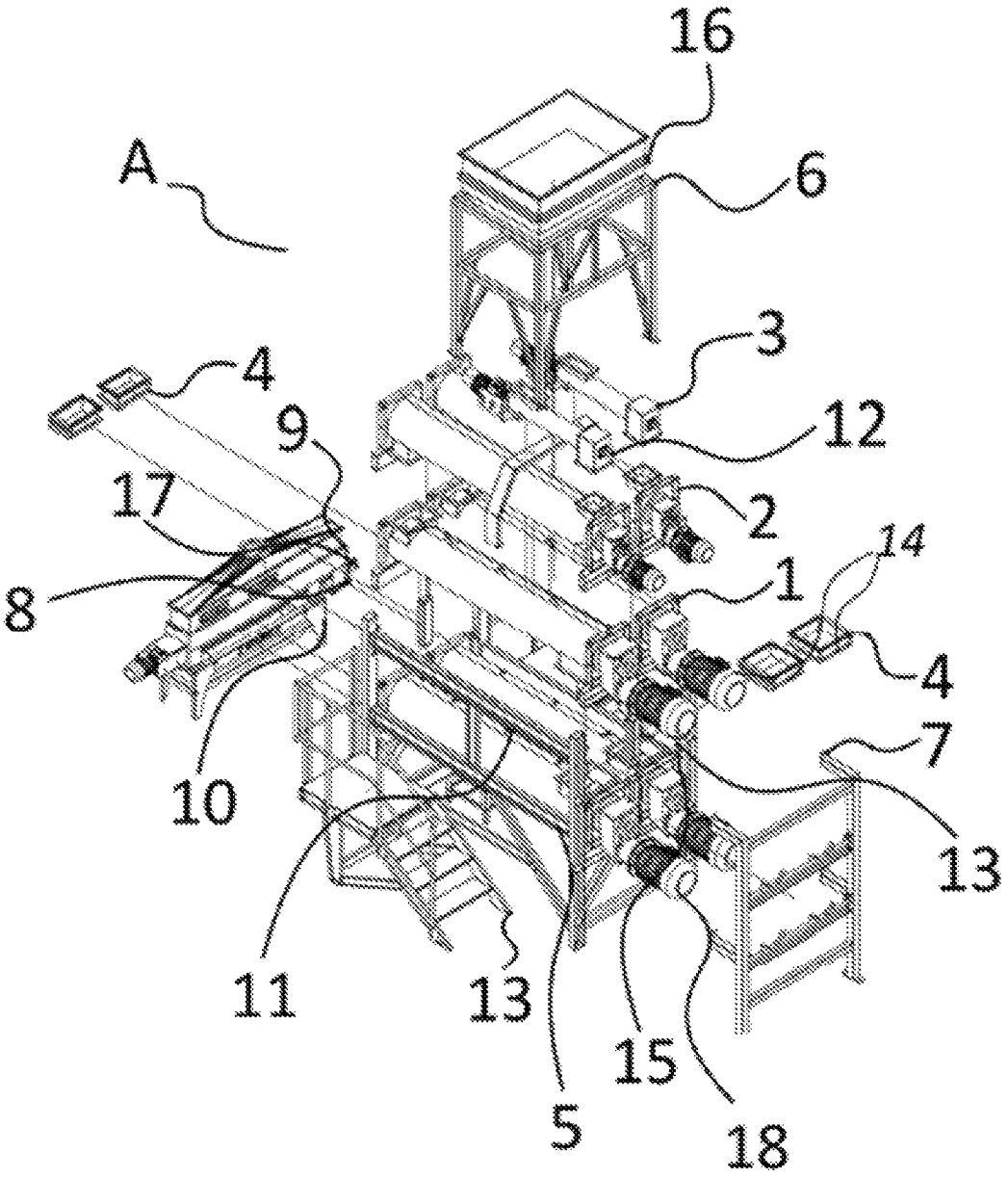
FIG. 1, is the general perspective disassembled visual of the hulling machine which is the subject of the invention.
Figure 2:
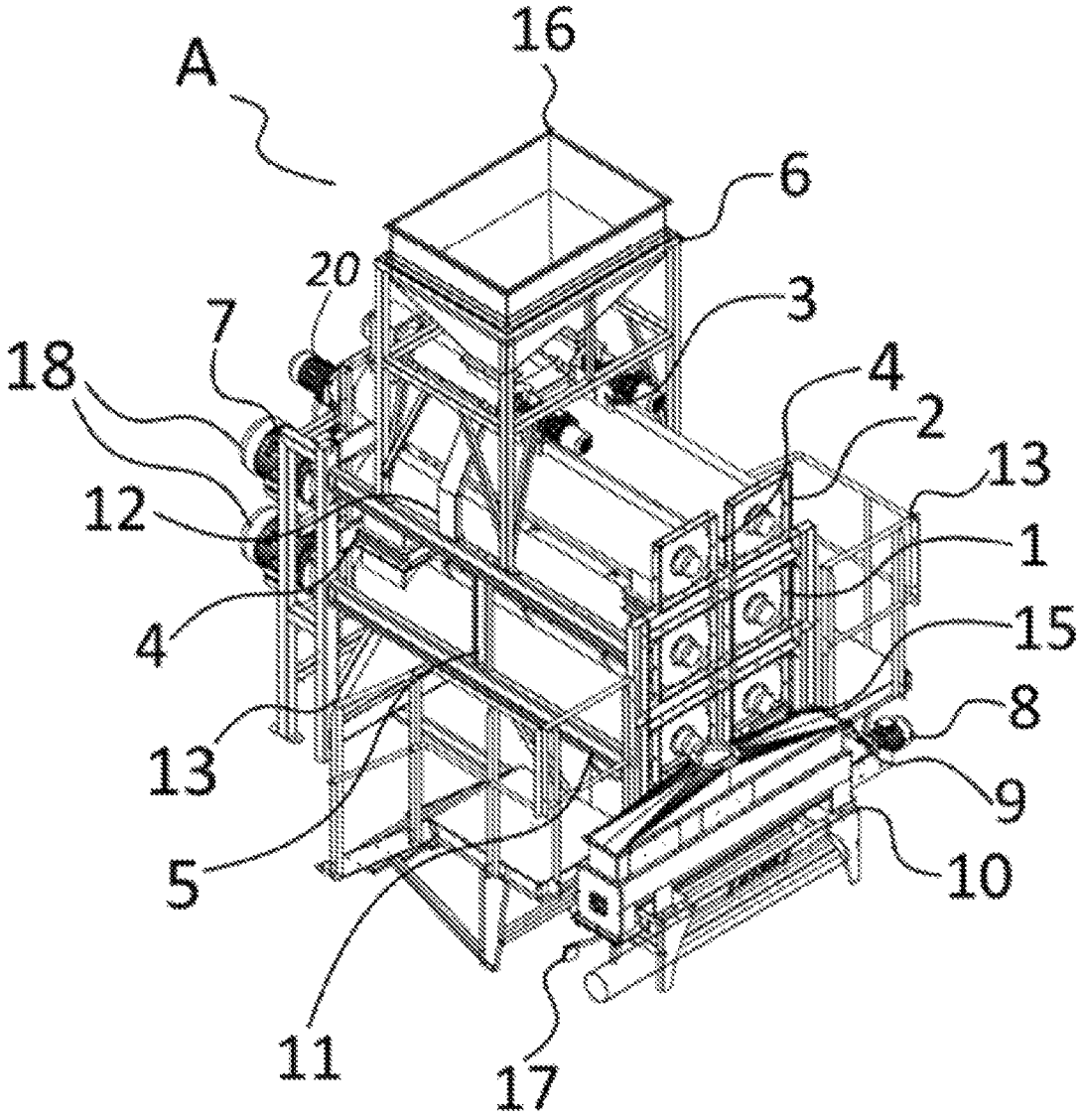
FIG. 2, is the general perspective assembled visual of the hulling machine which is the subject of the invention.

A. Hulling machine
1. Middle helix
2. Top mixer helix
3. Feeding helix
4. Duct drawers
4.1. Assembly rail profile
4.2. Assembly holes
5. Main body
6. Bearing chassis
7. Reductor support chassis
8. Mixing helix
9. Air vacuum hood
10. Mixing stand
11. Water tank
12. Feeding helix bearing chassis
13. Maintenance ladder 13 and 14 both to be 13
14. Connection bolts
15. Bottom body
16. Feeding bunker
17. Weighted valve
18. Propulsion reductors
19. Fore plates
19.1. Fixing holes
20. Connection elements
21. Drawer connection profile
100. Welded bearer chassis
110. Double sided lid
120. Cylindrical fore plate
a. Middle helix axis
b. Top mixer helix axis
c. Bottom body axis
d. Assembly distance

DETAILED DESCRIPTION OF THE INVENTION

The invention is about a hulling machine (A) that is hulling the sesame seed, to be used in facilities that are using sesame seeds as raw materials to produce tahini.

As it is seen in FIG. 1, the hulling machine (A), which is the subject of the invention, includes a main body (5), which is the main structure of the hulling machine (A). On the main body (5), there is a feeding bunker (16) which keeps the sesame seeds to be hulled, and feeds to the hulling machine (A). Under the feeding bunker (16), there is a bearing chassis (6) that is bearing the feeding bunker (16). Under the bearing chassis (6), there is at least one feeding helix (3) that is transferring the sesame seeds in the feeding bunker (16), to the top mixing helix (2). Under the feeding helix (3), there is a feeding helix bearing chassis (12) that is bearing the feeding helix (3).

As it is seen in FIG. 1, the hulling machine (A) which is the subject of the invention includes a middle helix (1) that is mixing the sesame seeds to be hulled, and a top mixing helix (2). Propulsion movement to the mentioned middle helix (1) and the top mixing helix (2) is provided by the propulsion reductors (18). It includes a demountable reductor support chassis (7) which provide that the mentioned propulsion reductors (18) are connected to the hulling machine (A), supporting it at the vertical axis. It includes connection elements (20) which fix the mentioned reductor support chassis (7) to the main body (5) on a demountable basis.

As it is seen in FIG. 1, the hulling machine (A) that is the subject of the invention, includes a mixing system (8) which is placed at the exit of the product, and which is separating the sesame seed and its hull. On the mixing system (8), there is a product exit duct which provide that the hulled sesame seed is moved out. On the mixing system (8), there is a bottom body (15) which bears the middle bunker (1). Under the mixing system (8), there is a mixing stand (10) which bears the mixing system (8). On the mixing stand (10), there is an air vacuum hood (9) which vacuums the dust created during the separation of the sesame seed and its hull. Under the air vacuum hood (9), there is a weighted valve (17). Mixing system (8) has the feature of being able to be mounted to the left or right of the main body (5), according to preference.

As it is seen in FIG. 1, the hulling machine (A) which is the subject of the invention includes a water tank (11) positioned under the middle helix (1). It includes at least one maintenance ladder (13), which is positioned at both sides of the hulling machine (A), and providing that it the hulling machine (A) is screwed for maintenance purposes.

Figure 3:
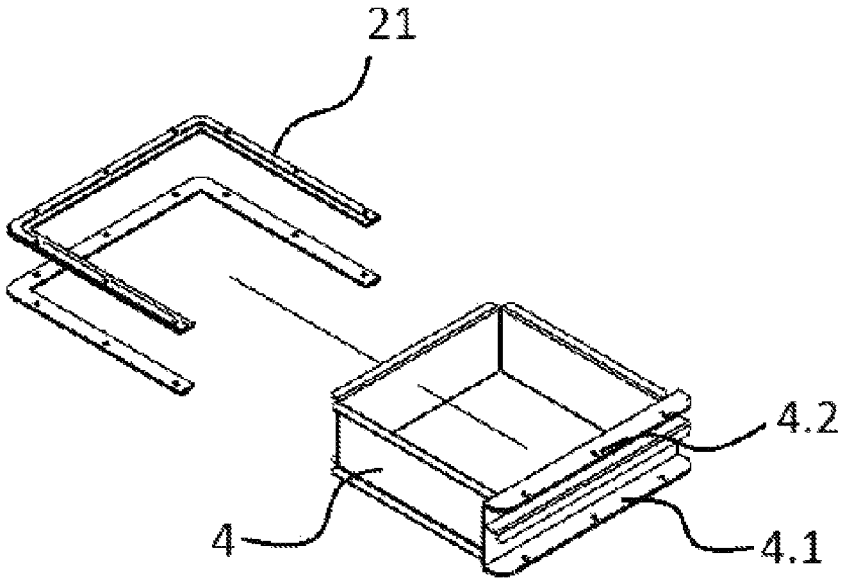
FIG. 3, is the perspective visual of the duct drawer and the drawer connection profile.

As it is seen in FIG. 3, the hulling machine (A) which is the subject of the invention includes demountable duct drawers (4), which provide that the sesame seeds are transferred from the top mixing helix (2) to the middle helix. On the duct drawer (4), there is an mounting rail profile (4.1) that is enabling that the duct drawer (4) to be fixed to the main body (5) in a mountable way. Drawer connection profile (21) which is connected to the main body (5) preferably by welding method, provides that the duct drawer (4) is fixed to the main body (5). Whereby, connection bolts (14) fix the duct drawer (4) to the drawer connection profile (21). Assembly holes (4.2) which are positioned on the assembly rail profile (4.1), provide that connection bolts are fixed to the drawer connection profile (21) of the duct drawer (4).

Figure 4:
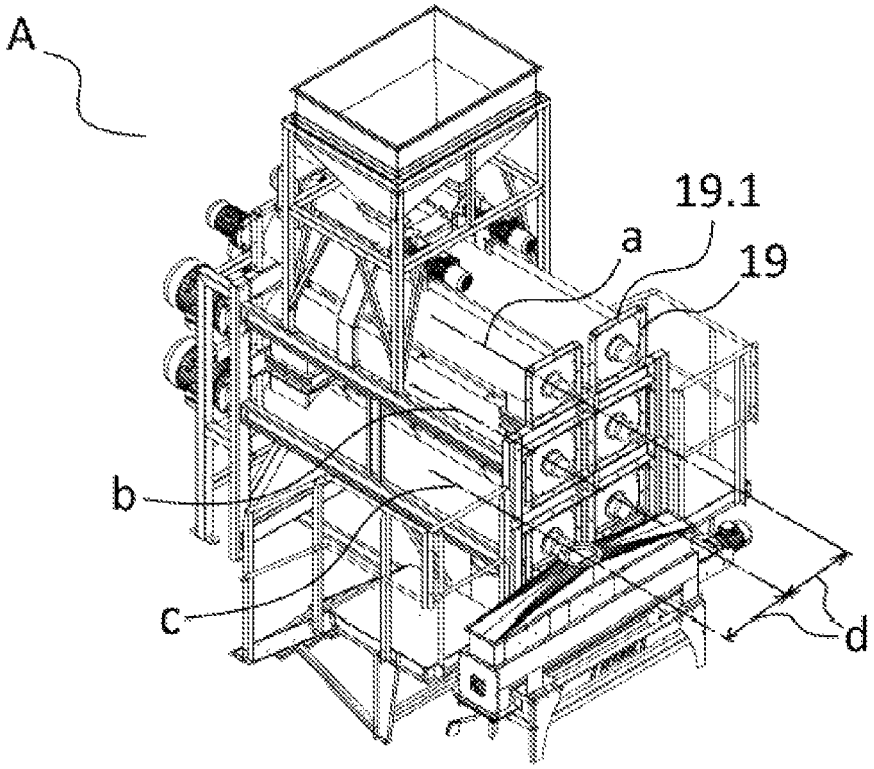
FIG. 4, is the perspective visual of the middle helix axis, top mixer helix axis, bottom body axis, assembly distance and fore plates.

As it is seen in FIG. 4, the hulling machine (A) which is the subject of the invention includes a middle helix (1), top mixing helix (2), and fore plates (19) which provide that the bottom body (15) is fixed to the main body (5), and which decrease assembly distance (d). On the mentioned fore plates (19), there are fixing holes (19.1) which provide that fore plates (19) are fixed to the main body (5) in a mountable way. Fore plates (19) are preferably manufactured as square profiled, to decrease the assembly distance (d). The mentioned assembly distance (d) is the distance between the middle helix axis (a), top mixing helix axis (b), and the bottom body axis (c).

In line with the information provided above, the hulling machine (A) which is the subject of the invention works as follows.

As it is seen in FIG. 1, the sesame seed which is to be hulled is received to the hulling machine (A) from the feeding bunker (16). Sesame seeds poured from the feeding bunker (16) are poured to the middle helix (1) and the top mixing helix (2), through the feeding helix (3). The hull of the sesame seed that is arriving to the middle helix (1) and top mixing helix (2) is broken, and then it arrives at the mixing helix (8). Here, the lumpy creations formed by the sesame seed and its hull are separated.

Figure 5:
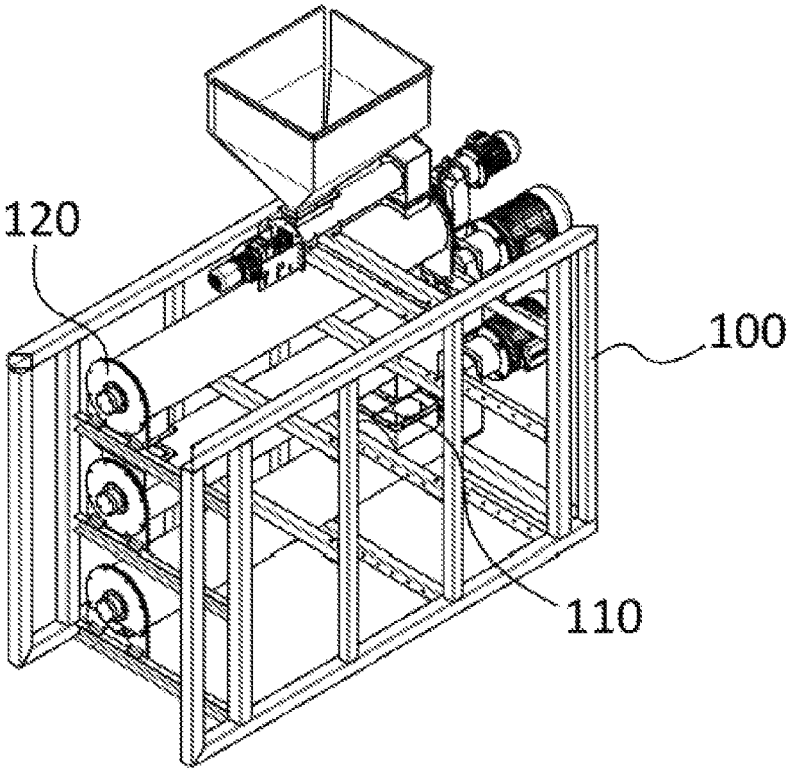
FIG. 5, is the perspective visual of the welded bearing chassis, double sided lid, and cylindrical fore plate of the current known technique.

For vertically supporting the propulsion reductors (18) which provide propulsion to middle helix (1) and the top mixing helix (2), reductor support chassis (7) is used. As it is seen in FIG. 5, in the known current state of the technique, the welded main chassis (100) is mounted by welding. However, in the hulling machine (A) which is the subject of the invention, reductor support chassis (7) is mounted to the main body (5) by the connection elements (20). Also, instead of the double sided lid (110) in the known current state of the technique in FIG. 5, duct drawers (4) are used which are mounted to the main body (5) in a demountable way, therefore maintenance and assembly have become easier.

As it is seen in FIG. 5, in the known current state of the technique, cylindrical fore plate (120) cause the assembly distance (d) to increase, and because of the structure including welding, cause the manufacturing duration to increase. Fore plates (19) used in the hulling machine (A) which is the subject of the invention are manufactured as square profiles, to decrease the assembly distance (d). Additionally, through the fixing holes (19.1) on it, it can be mounted on the main body (5) in a demountable way.

The invention claimed is:

1. A sesame seed hulling machine (A) comprising:

a body (5), a middle helix (1) which provides mixing of the sesame seeds to be hulled, a top mixing helix (2), an air vacuum hood (9) which vacuums the dust created when the seed and the hull are being separated, a demountable reductor support chassis (7), which provides that propulsion reductors (18) are mounted to the hulling machine (A), and support them vertically, a duct drawer (4) in a modular structure which provides that the sesame seeds are transferred from the top mixing helix (2) to the middle helix a fore plate (19) which provides that middle helix (1), top mixing helix (2) and the bottom body (15) are fixed to the main body (5), and decreasing an assembly distance (d), and an assembly rail profile (4.1) which provides that the duct drawer (4) is fixed to the main body (5) in a demountable way.

2. The hulling machine (A) according to claim 1 further comprising, a mixing system (8) that can be mounted both at the right and left of the mentioned main body (5), and is separating the seed and hull from each other.

3. The hulling machine (A) according to claim 1 further comprising, an assembly hole (4.2) which provide that the duct drawer (4) is fixed to a drawer connection profile (21).

4. The hulling machine (A) according to claim 1 further comprising, a mixing stand (10) that is bearing a mixing system (8) on it.

5. The hulling machine (A), according to claim 1, further comprising a plurality of connection bolts (14) which provide that the duct drawer (4) is fixed to a drawer connection profile (21).

6. The hulling machine (A) according to claim 1 further comprising, fixing holes (19.1) which provide that fore plates (19) are fixed to the main body (5) in a demountable way.

7. The hulling machine (A) according to claim 1 wherein the fore plate (19) comprises a square profile to decrease the assembly distance (d).

8. The hulling machine (A) according to claim 1 further comprising, connection elements (20) that are fixing the reductor support chassis (7) to the main body (5) in a demountable way.

9. The hulling machine (A) according to claim 1 further comprising, a drawer connection profile (21) which provides that the duct drawer (4) is fixed to the main body (5).

* * * * *